United States Patent [19]

Marshall et al.

[11] Patent Number: 4,838,158

[45] Date of Patent: Jun. 13, 1989

[54] SELF-INKING ARTICLE MARKING DEVICE

[75] Inventors: Steven F. Marshall, Menomonee Falls, Wis.; Richard E. Haden, Jr.; Darrell R. Johnson, both of Nashville, Tenn.

[73] Assignee: United Health, Inc., Milwaukee, Wis.

[21] Appl. No.: 186,037

[22] Filed: Apr. 25, 1988

[51] Int. Cl.[4] ..... B41K 1/42

[52] U.S. Cl. ..... 101/105; 101/104; 101/333; 101/334

[58] Field of Search ..... 101/42, 35, 43, 93.47, 101/93.44, 104, 105, 111, 333, 334

[56] References Cited

U.S. PATENT DOCUMENTS

| | | | |
|---|---|---|---|
| 315,286 | 4/1885 | Hill | 101/104 |
| 401,455 | 4/1989 | Nelson | 101/318 |
| 669,137 | 3/1901 | Dobbel | 101/105 |
| 703,011 | 6/1902 | Smith | 101/333 |
| 730,968 | 6/1903 | Reynolds et al. | 101/318 |
| 1,275,893 | 8/1918 | Folger | 101/333 |
| 1,548,496 | 8/1925 | Weeks et al. | 101/43 |
| 1,574,367 | 2/1926 | Commander | 101/42 |
| 1,600,025 | 9/1926 | Wegman | 101/333 |
| 2,040,524 | 5/1936 | Mumma et al. | 101/35 |
| 2,070,512 | 2/1937 | Corey | 101/111 |
| 3,164,086 | 1/1965 | Keck | 101/111 |
| 3,307,479 | 3/1967 | Messmer | 101/334 |
| 3,359,897 | 12/1967 | Harte | 101/334 |
| 3,760,721 | 9/1973 | Stier, Sr. | 101/334 |
| 3,783,786 | 1/1974 | Ellison et al. | 101/333 |
| 4,013,007 | 3/1977 | Flynn | 101/333 |

FOREIGN PATENT DOCUMENTS

| | | | |
|---|---|---|---|
| 1207808 | 1/1986 | U.S.S.R. | 101/333 |

*Primary Examiner*—Edgar S. Burr
*Assistant Examiner*—Kimberly L. Asher
*Attorney, Agent, or Firm*—Quarles & Brady

[57] ABSTRACT

An apparatus for marking an article has a frame within which a printing carriage is rotatably mounted. The carriage has two fulcrum assemblies which slide in channels on the frame. A drive mechanism moves the carriage from a marking position to a position where ink is applied to selected printing characters on the carriage. The carriage is moved to a third position where the fulcrum assemblies are released from the channels to rotate the carriage to facilitate changing the printing characters.

8 Claims, 3 Drawing Sheets

SELF-INKING ARTICLE MARKING DEVICE

The present invention relates to article marking devices and particularly to such devices of the self-inking kind with interchangeable characters.

BACKGROUND OF THE INVENTION

U.S. Pat. No. 401,455 issued Apr. 16, 1889 discloses a hand operated printing machine having a flat type carrier mounted on a hand-lever assembly. The lever assembly allows the type carrier to be moved between two positions on a planar platen. In one position, the printing type is pressed against a pad which contains ink. Once the ink has been applied to the type, the lever assembly is activated to move the type to a second position in which the type is pressed against the article to be marked. The article is held against a platen by two clips. In order to change the imprint pattern, the type carrier must be replaced with one containing the new pattern.

A hand operated rubber stamp marking device is shown in U.S. Pat. No. 4,013,007 issued on Mar. 22, 1977. This device has a printing unit with a number of bands each containing a set of type characters. A character on each band is selected by moving the band until the desired character is located at a marking location on the printing unit. By pressing on the handle of the machine, the printing unit is moved from an inking position to a stamping position where the printing unit is pressed against the article to be marked. Releasing the handle automatically returns the printing unit to its inking position.

In certain applications it is desirable to mark an article with alpha-numeric symbols. For example, the laundry of a nursing home or other institution may wish to stamp a patient's name on his articles of clothing to facilitate sorting the articles after laundering. In this application, the characters include the letters of the alphabet and decimal digits as well as special symbols. Previous hand held stamp machines are impractical for such application because of the size of the bands needed to accommodate all of the alpha-numeric characters, as well as the number of bands necessary to imprint an individual's entire name.

SUMMARY OF THE INVENTION

An article marking device according to the present invention has a base which supports the article to be marked. A frame extends from the base and contains a printing unit therewithin. The printing unit includes a character carriage with means to shift different characters into a printing location on the carriage. The frame also contains means for applying ink to the characters at the printing location. A mechanism is provided for moving the printing unit between a first position at which ink is applied to the characters and a second position where the article is marked by the printing unit.

An object of the present invention is to provide a device for marking an article with a number of characters simultaneously. In addition the device includes a mechanism for selecting each character from a plurality of characters.

Another object is to provide a device for marking names of individuals on the articles.

The present device includes a self-inking mechanism and means for moving the characters from an inking position to a stamping position.

Yet another object is to provide a third position at which the characters for marking the article are changed.

DETAILED DESCRIPTION OF THE PRESENT INVENTION

Figure 1:
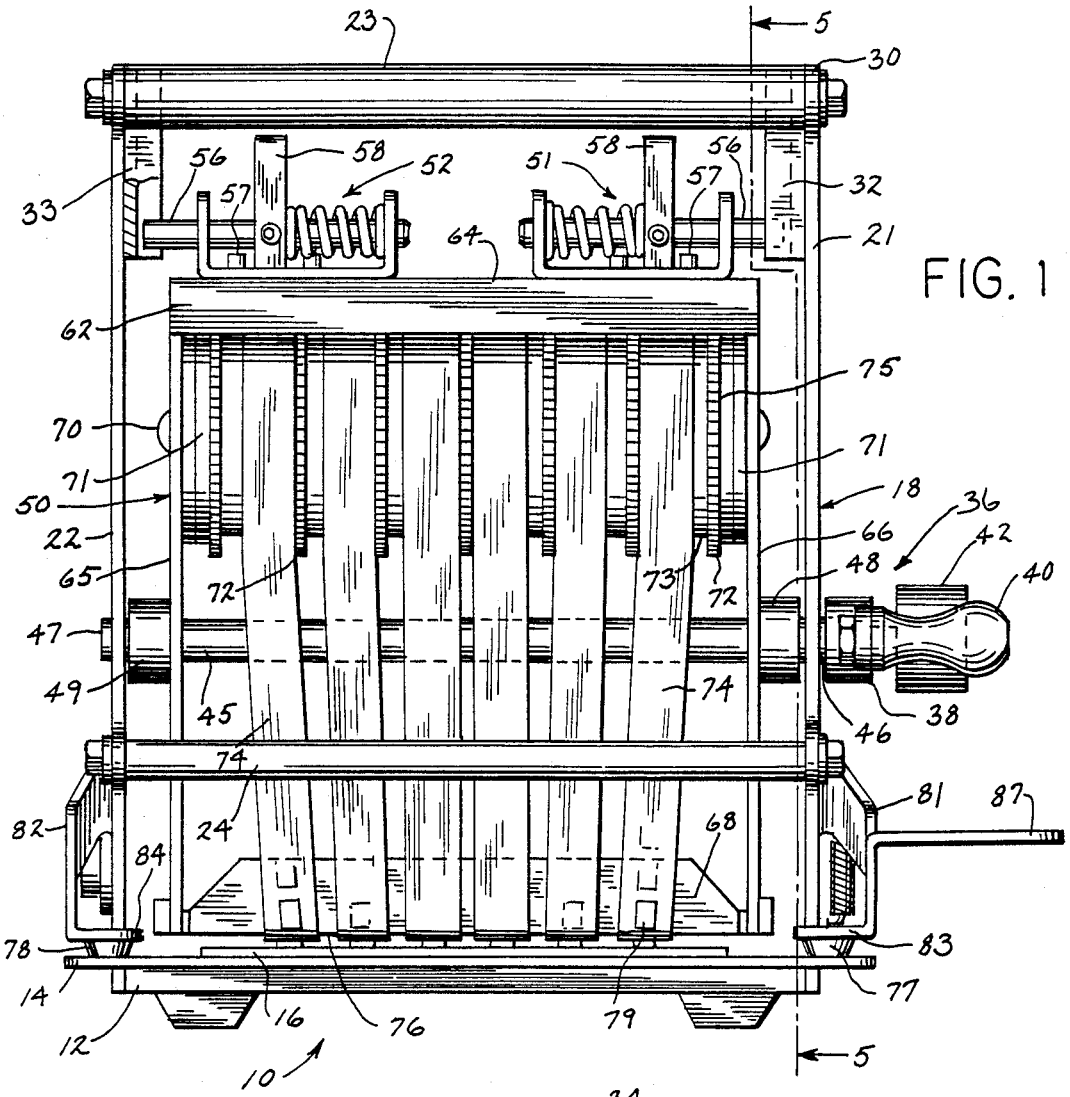
FIG. 1 is a front elevation view showing a article marking mechanism according to the present invention.
Figure 3:
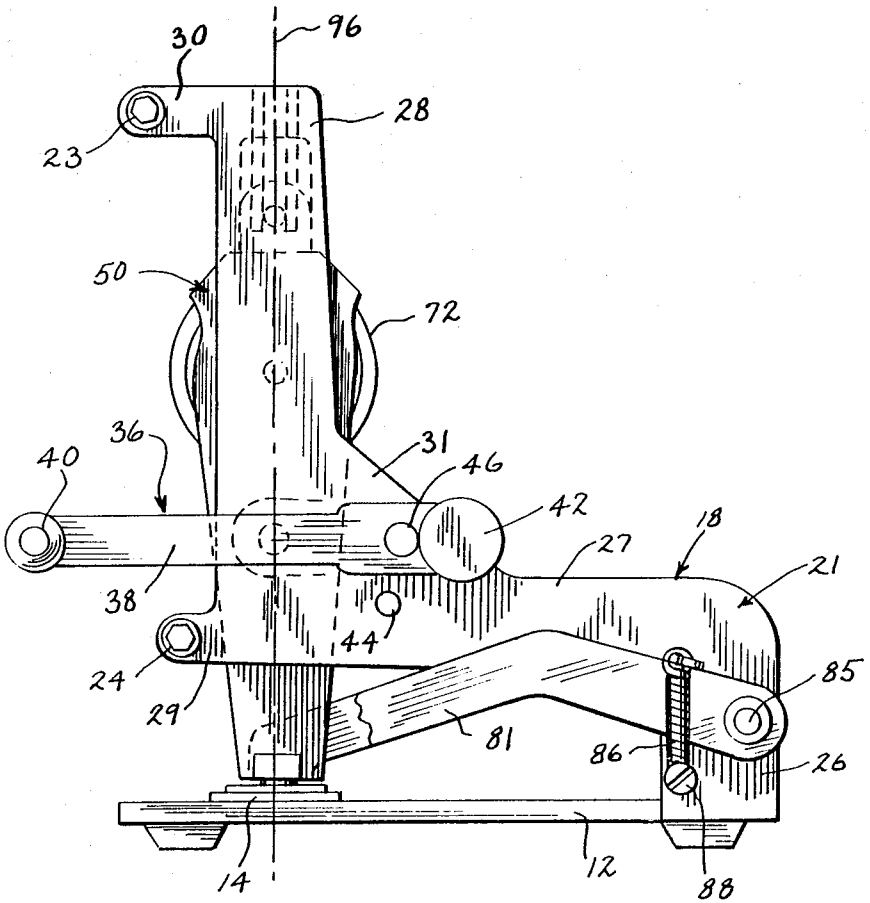

As shown in FIGS. 1 and 3, an article marker 10 comprises a base 12 with a platen 14 disposed thereon. The platen may have a rubber pad 16 on its upper surface which is remote from the base 12. Extending upward from the base 12, is a frame 18 that includes two side supports 21 and 22 fastened on opposite sides to the rear of the base 12. The frame 18 is further formed by upper and lower support rods 23 and 24, respectively, extending between front portions of the side supports 21 and 22.

The side profile of each of these side supports 21 and 22 is identical. As shown in FIG. 3, side support 21 consists of a first vertical section 26 attached to and extending upwardly from the rear of one side of base 12. A horizontal section 27 of side support 21 extends from the upper portion of the first vertical section 26 toward the front of the marker 10. A lower lug 29 projects from the front edge of the horizontal section 27 and provides an attachment for the lower support rod 24. A second vertical section 28 extends upwardly from a front portion of the horizontal section 27. The interior corner of the intersection of the horizontal section 27 with the second vertical section 28 is formed by a triangular portion 31. An upper lug 30 projects forward from the top of the second vertical section 28 providing an attachment for the upper support rod 23.

Figure 2:
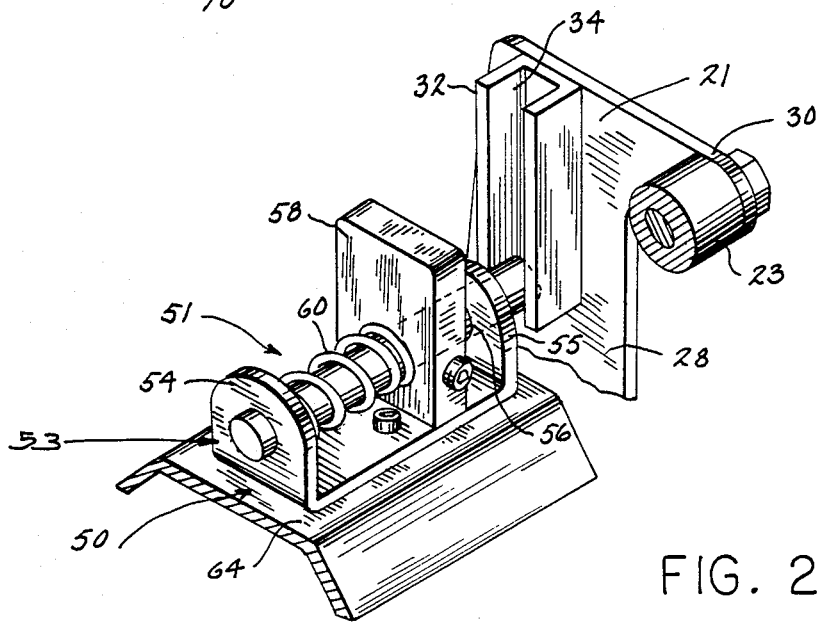
FIG. 2 is an isometric view of a portion of the mechanism in FIG. 1.

With reference to FIG. 2, an elongated U-shaped member 32 is fastened to the interior surface of the top portion of the second vertical section 28 so that the channel 34 of the U-shaped member extends vertically. A similar U-shaped member 33 is fastened to the upper portion of the interior surface of the opposite side support 22 (see FIG. 1). Alternatively, the function of the channels 34, as will be described, can be provided by replacing the U-shaped members 32 and 33 with elongated vertical slots cut in the side supports 21 and 22.

Figure 5:
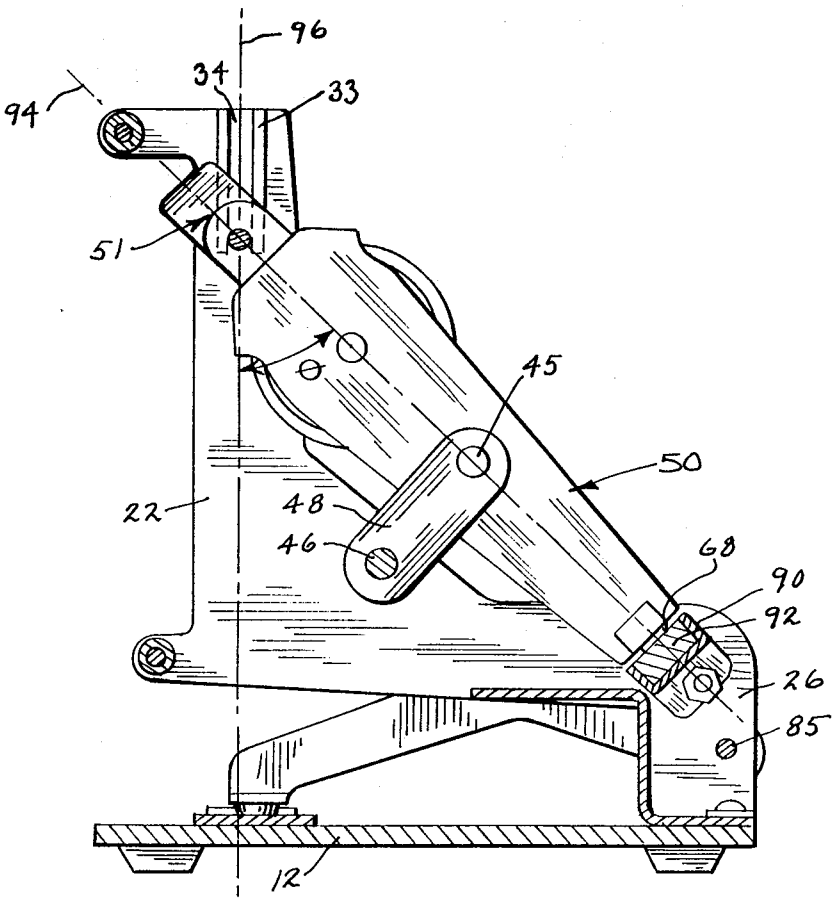
FIG. 5 is a cross-sectional view taken along lines 5—5 of FIG. 1 when the marking device is in the position shown in FIG. 4.

As shown in the cutaway view of FIG. 5, the frame also includes a trough 90 extending between the first vertical section 26 of each of the side supports 21 and 22. Contained within the trough 90 is an inking pad 92 of conventional material.

Referring again to FIGS. 1 and 3, two article holding arms 81 and 82 are located on opposite sides of the frame 18 near the base 12. Each of the article holding arms 81 and 82 is fastened to an arm shaft 85 which rotatably extends through apertures in the first vertical section 26 of each side support 21 and 22. The end of each of the article holding arms 81 and 82 which is remote from shaft 85 has an inwardly extending flange 83 and 84 respectively. Each flange 83 and 84 has a rubber foot 77 and 78 on its lower surface. One arm 81 has a finger lever 87 for raising the arms. The one arm 81 also has a spring 86 extending to a bolt 88 attached to the first side support 21. The spring 86 biases the article holding arms 81 and 82 so that their rubber feet 77 and 78 are held against the platen 14. This bias force clamps the article to be marked between the article holding arms 81 and 82 and the platen 14.

Figure 6:
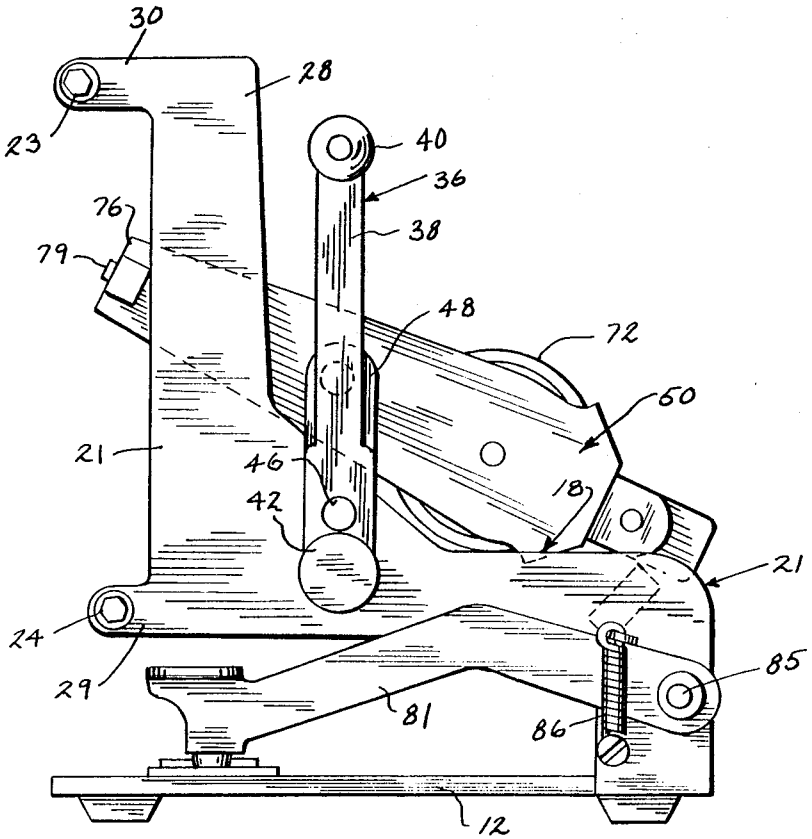
FIG. 6 is a side elevation of the marking device in the character changing position.

On the side of the marker 10 having support 21 is a handle assembly 36 consisting of lever 38 with a knob 40 rotatably attached to one end. At the other end of lever 38 is a knurled knob 42 affixed to a shaft (not visible) which extends through an aperture in the other end of lever 38. The shaft of the knurled knob 42 is adapted to longitudinally slide through the lever aperture and engage an aperture 44 in side support 21 when the lever is in the vertical position as shown in FIG. 6. This engagement of the knurled knob shaft with aperture 44 serves to lock the lever 38 in the vertical position. Referring again to FIGS. 1 and 3, the other end of the lever 38 has a second aperture into which one end of a drive shaft 46 is fixedly positioned. The drive shaft 46 extends from the lever 38 through an aperture in the side support 21 to become attached to one end of a drive lever 48.

The other side support 22 has an aperture through which a support shaft 47 extends aligned with the drive shaft 46 extending through side support 21. The support shaft 47 may freely rotate within the aperture in the support 22 but is attached at one end to a support lever 49 which is identical to drive lever 48. A pivot shaft 45 extends between apertures in the free ends of the drive lever 48 and the support lever 49 and is attached thereto. The pivot shaft 45 also rotatably extends through a printing carriage 50 positioned between the two side supports 21 and 24.

The printing carriage 50 is similar to that used in band type, hand operated date stamps. With reference to FIG. 1 and the orientation of the marker 10 therein, the printing carriage 50 consists of an upper member 62 having an outer surface 64 to which a pair of fulcrum assemblies 51 and 52 are attached. Two carriage side members 65 and 66 extend downward from the top member 62. A thick pressure bar 68 extends across the lower ends of each of carriage side members 65 an 66 forming a closed frame for the printing carriage 50. A carriage shaft 70 extends between the two side members 65 and 66 adjacent to the upper member 62. Located on the carriage shaft 70 are six coaxial character band wheels 72. Two spacer washers 71 are located on the carriage shaft 70 adjacent each sidewall 65 and 66.

Extending around a first diameter portion 73 of each character band wheel 72 is a separate character band 74. For ease of illustration, only six character bands are shown, eighteen bands are typically provided on devices used to mark people's names. Each character band 74 is a continuous loop of rubber with the reverse image printing characters 79 on its outer surface. Each character band 74 also extends around the pressure bar 68 within a notch on the bottom surface 76 of the pressure bar. The notches permit the outer bands 74 to angle inward toward the center of the pressure bar 68 as they extend from the character band wheels 72. This angling enables the bands and their characters to be spaced closer together at the printing location on the bottom surface 76 of the pressure bar 68. The bands 74 are stretched slightly so as to be taut around the pressure bar 68 and each print band wheel 72. Each character band wheel 72 has a second larger diameter portion 75 which is used to rotate the wheel and its character band 74 to change the corresponding character 79 on the band that is adjacent the bottom surface 76 of the pressure bar 68.

In addition to being supported by pivot shaft 45, the printing carriage 50 is held between each of the side supports 21 and 22 of frame 18 by the fulcrum assemblies 51 and 52. Fulcrum assembly 51 will be described in detail with reference to FIGS. 1 and 2. Assembly 51 has a U-shaped shaft support 53 attached at the base of the U to the outer surface 64 of the printing carriage 50. The shaft support 53 has two upwardly extending legs 54 and 55 each having aligned apertures therethrough. A fulcrum shaft 56 extends through the apertures in each of the legs 54 and 55 and has an end that is positioned within the channel 34 of the U-shaped member 32 fastened to side support 21. The diameter of the fulcrum shaft 56 is less than the width of the channel 34, so that the shaft may freely slide within the channel. A fulcrum release lever 58 is fixedly attached to the portion of the fulcrum shaft 56 which extends between the two shaft support legs 54 and 55. A compression spring 60 is located around the fulcrum shaft 56 between the inner leg 54 and the fulcrum release lever 58. The spring 60 causes the fulcrum shaft 56 to be pushed into the channel 34. Cap screw 57 serves as a stop for fulcrum release lever 58 so that the spring 60 will not press the end of the fulcrum shaft 56 against the side support 21. This prevents a binding of the vertical movement of the fulcrum shaft 56 within the channel 34 as the carriage 50 is moved between inking and marking positions. The other fulcrum assembly 52 is a mirror image of fulcrum assembly 51. The fulcrum shaft of the second fulcrum assembly 52 extends into the channel of U-shaped member 33 on side support 22.

Prior to marking an article, the operator places the handle assembly 36 in the vertical position as shown in FIG. 6. The knurled knob 42 is then pushed inward so that its shaft engages aperture 44 in the side support 21. This engagement locks the lever 38 and thereby the printing carriage pivot shaft 45 in a fixed position. At this point, the fulcrum shafts 56 of each of the fulcrum assemblies 51 and 52 are still engaging the channel 34 on each of the side supports 21 and 22.

As best shown in FIG. 1, the operator then grasps the two fulcrum release levers 58 between his index finger and thumb of one hand, pressing them toward each other. This action causes the fulcrum shaft 56 connected to each release lever 58 to retract from each of the side support channels 34. This releases the upper fulcrum points of the printing carriage 50 allowing the top portion of the carriage to be rotated about the pivot shaft 45 toward the rear of the marker frame 18 until it rests in a position shown in FIG. 6. In this position, the operator, observing the marker 10 from the front, views the bottom surface 76 of pressure bar 68 containing the characters 79 on the character bands 74 which are located in the marking location of the carriage 50. The operator then rotates each of the bands 74 by moving the corresponding character band wheel 72 until the desired character 79 is positioned at the marking location on the bottom surface 76.

Once each of the characters 79 has been selected, the operator rotates the printing carriage 50 into a substantially upright position. The fulcrum release levers 58 are then pressed together so that the fulcrum shafts 56 may line up with the channels 34. The pressure on the fulcrum release levers 58 is then removed so that the fulcrum shafts 56 once again engage the side support channels 34. Next, the operator grasps the lever knob 40 holding it in place while the knurled knob 42 is pulled outward to disengage its shaft 43 from aperture 44.

Figure 4:
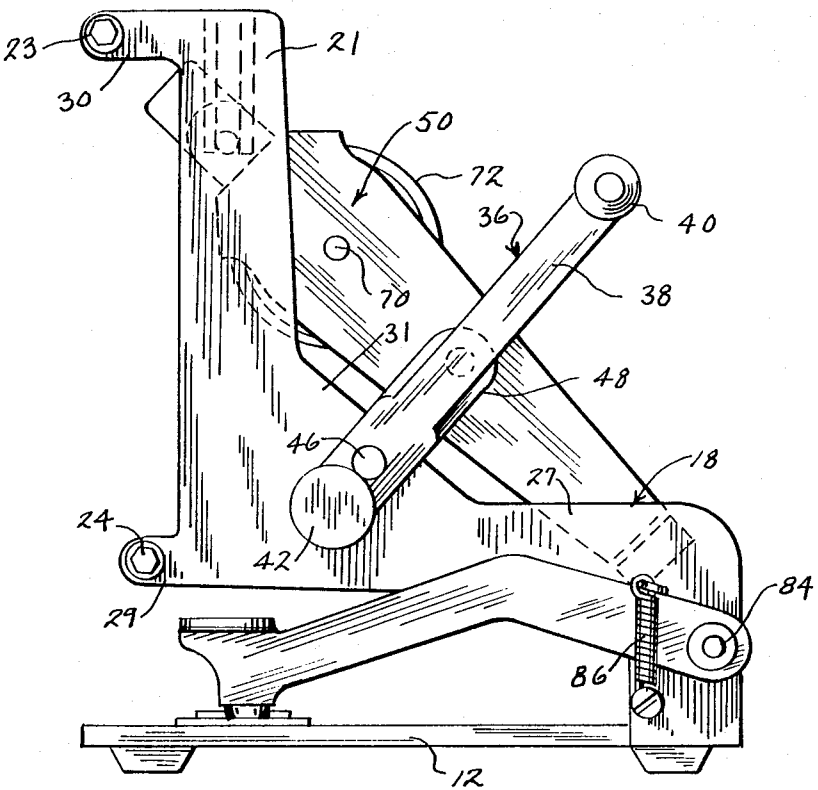
FIGS. 3 and 4 are side elevation views of the marking device in two different positions during the marking cycle.

The handle assembly 36 is then moved backward into the position shown in FIG. 4 so that the selected characters 79 on the bottom surface 76 of pressure bar 68 are pressed against the inking pad 92, as illustrated in FIG. 5. In this position the carriage 50 is in a first plane represented by line 94. Once ink has been applied to the selected characters 79, the handle assembly 36 is rotated forward into the horizontal position shown in FIG. 3 where the selected characters 79 at the marking location of the printing carriage 50 are pressed against the article held on platen 14. In this marking position, the carriage 50 is in a second plane represented by line 96.

The carriage 50 is then returned to the inking position so that the marked article can be removed from the marker 10. The marked article is removed by lifting up on the article holding arm 81. A new article may be placed on the platen 14 and the article holding arms 81 and 82 released to hold the article in that position. The operator then may once again grasp the knob 40 and move the lever 38 to drive the carriage 50 into the stamping position.

The movement of the handle assembly 36 causes a rotation of the drive shaft 46 connected to the lever 38. The rotation of the drive shaft 46 results in a pivoting of the drive lever 48 connected to the other end of the shaft. This in turn causes the pivot shaft 45 to move in an arc which produces a movement of the printing carriage 50. When the carriage 50 is driven by the pivot shaft 45, the fulcrum shafts 56 move up and down within the side support channels 34. The length of the side support channels 34 is selected so that the fulcrum shafts 56 do not slide out of the ends of the channels. This provides a slidable fulcrum means in which the pivot axis moves within the channel 34 as the carriage is moved through angle $\theta$ shown on FIG. 5.

As the marker 10 does not use any spring mechanisms to drive the printing carriage 50, the carriage has a first stable position as shown in FIG. 3 where it is against the article in the marking position. The printing carriage 50 has a second stable position shown in FIGS. 4 and 5 where the selected characters are against the inking pad 92. The plane 96 of the carriage 50 in the first position is at an acute angle $\theta$ to the plane of the carriage in the second position 94.

We claim:

1. An apparatus for marking an article comprising:

a frame including two support structures each having a fulcrum channel;

a carriage having a plurality of printing characters and means for selecting ones of the characters for marking the article;

a means for applying ink to said selected characters;

two fulcrum assemblies attached to said carriage, each having a shaft and means for releasably engaging the shaft with one of the fulcrum channels of said frame;

a first lever pivotally coupled to one of said support structures and pivotally coupled to said character carriage;

a second lever pivotally coupled to said character carriage; and a drive shaft pivotally coupled to the other support structure and fixed to said second lever.

2. The apparatus as in claim 1 further comprising a hand operable lever fixed to said drive shaft.

3. An article marking device comprising:

a frame having two opposed side walls each side wall including a fulcrum channel;

a carriage including a plurality of printing characters and means for selecting ones of the characters for marking the article;

two fulcrum assemblies attached to said carriage, each fulcrum assembly having a shaft which engages the fulcrum channel of one of the side walls;

means for retracting the shafts of the fulcrum assemblies from engagement with the respective fulcrum channel; and means for moving said carriage with respect to said frame between an article marking position and a character inking position while the shafts of said fulcrum assemblies are engaged with said fulcrum channels, said carriage being moveable to a character changing position when the shafts of said fulcrum assemblies are retracted from said fulcrum channels.

4. The article marking device as recited in claim 3 wherein said means for retracting the shafts of the fulcrum assemblies comprises a separate release lever fixedly attached to each shaft; and a separate spring biasing each release lever causing the attached shaft to extend into one of the fulcrum channels.

5. The article marking device as recited in claim 3 wherein said means for moving said carriage comprises:

a first lever pivotally connected directly to one of the side walls and pivotally connected directly to said carriage;

a second lever pivotally connected to said carriage; and a drive shaft attached to said second lever and extending through an aperture in the other of the side walls.

6. The article marking device as recited in claim 5 further comprising a third lever attached to said drive shaft and having a handle.

7. The article marking device as recited in claim 3 further comprising means connected to said frame for applying ink to selected characters when said carriage is in the character inking position.

8. The article marking device as recited in claim 3 wherein said frame includes a base connected to the side walls for supporting the article to be marked, and means for holding the article against the base.

* * * * *